United States Patent [19]

Umeno et al.

[11] Patent Number: 4,591,133

[45] Date of Patent: May 27, 1986

[54] COOLING APPARATUS FOR THICK STEEL PLATE

[75] Inventors: Masaki Umeno; Keiji Fukuda; Yasumitsu Onoe, all of Kitakyushu, Japan

[73] Assignee: Nippon Steel Corporation, Tokyo, Japan

[21] Appl. No.: 671,798

[22] Filed: Nov. 15, 1984

Related U.S. Application Data

[63] Continuation of Ser. No. 443,654, Nov. 22, 1982, abandoned.

[30] Foreign Application Priority Data

Nov. 20, 1981 [JP] Japan ..... 56-186452

[51] Int. Cl.[4] ..... C21D 1/62

[52] U.S. Cl. ..... 266/114; 72/201; 266/134

[58] Field of Search ..... 72/201; 266/111-114, 266/117, 134, 81, 83, 87, 88, 90

[56] References Cited

U.S. PATENT DOCUMENTS

| | | | |
|---|---|---|---|
| 2,211,981 | 8/1940 | McBain et al. | 72/201 |
| 4,392,367 | 7/1983 | Bald | 72/12 |

FOREIGN PATENT DOCUMENTS

| | | | |
|---|---|---|---|
| 197805 | 5/1978 | Fed. Rep. of Germany | 72/201 |
| 51-141757 | 12/1976 | Japan . | |
| 53-99311 | 8/1978 | Japan . | |
| 51-105908 | 9/1978 | Japan . | |
| 88921 | 7/1980 | Japan | 72/201 |
| 14016 | 2/1981 | Japan | 72/201 |
| 74301 | 6/1981 | Japan | 72/201 |
| 41317 | 3/1982 | Japan | 148/143 |
| 759165 | 8/1980 | U.S.S.R. | 72/201 |

*Primary Examiner*—Christopher W. Brody

*Attorney, Agent, or Firm*—Wenderoth, Lind & Ponack

[57] ABSTRACT

A cooling apparatus for uniformly cooling a thick steel plate in order to obtain a very flat thick steel plate constituted by a cooling water supply apparatus provided with more than two header systems by which a desired water volume crown is given in the width direction of the thick steel plate.

6 Claims, 18 Drawing Figures

COOLING APPARATUS FOR THICK STEEL PLATE

This application is a continuation, of now abandoned application Ser. No. 443,654, filed Nov. 22, 1982.

BACKGROUND OF THE INVENTION

1. Field of the Invention

The present invention relates to a cooling apparatus for cooling thick steel plate wherein the amount of water applied for cooling can be controlled in the width direction of the thick steel plate.

2. Description of the Prior Art

Considerable research has recently been devoted to the process for production of thick steel plate with the aim of developing a process which, through the combination of low temperature rolling and forced cooling, will make it possible to reduce the amount of alloying elements required in thick steel sheet production, to carry out various processes with smaller energy consumption and to develop new types of steel products. This research has already produced substantial results.

The cooling apparatuses developed for the process encompassing such a combination of steps have been aimed at making it possible to carry out the cooling operation in a simple manner, thereby overcoming the problem of insufficient cooling capacity posed by the conventional cooling bed, and at realizing an improvement in steel quality, more particularly, in realizing a remarkable enhancement of steel strength and toughness. It is a requirement of the cooling operation that the cooling be uniform in order to respond to the demand for higher steel quality. Also, it is a requirement of the steel plate that, following the completion of the cooling step, it should have a degree of flatness sufficient for it to be used immediately as a commercial product. This requirement derives from the need to save energy and reduce the number of production processes.

The inventors of the present invention have devoted themselves to the development of a cooling apparatus capable of providing the uniform cooling required to satisfy the aforesaid conditions. Through their study they found that no matter how perfectly a cooling apparatus is able to carry out uniform distribution of water, when a steel plate of large area is subjected to transient type cooling, a number of factors, including some intrinsic to the steel plate itself, act to obstruct uniform cooling. The main ones of these factors are listed below:

(1) Plate crown

It is the nature of a rolling mill to produce a steel plate which is thicker at the center (crown) than at the edges. The tendency for this to occur increases with decreasing plate thickness and increasing plate width. For instance, in a steel plate that is 12 mm thick and 4000 mm wide, the height of the crown is about 0.3 mm while, in contrast, in a steel plate that is 40 mm thick and 2000 mm wide, the height of the crown is nearly 0 mm.

Therefore, even if perfectly uniform cooling could be carried out on both (top and bottom) sides of the plate, the cooling rate at the center portion would be slower proportionally to the difference in plate thickness (which in turn depends on the size of the plate) so that the plate will suffer from fluctuation in steel quality and defects in shape.

(2) Temperature of the plate immediately before cooling

In an industrial process for heating and rolling a steel plate, the plate will inevitably undergo a drop in temperature due to the cooling effect of the air that constitutes the environment for the operation. This effect tends to be stronger at thinner portions of the plate so that it sometimes happens that the temperature at the edge portions of the plate immediately before cooling is a much as 20° C. lower than the temperature at the center.

When a steel plate having such temperature differences is then subjected to cooling, these differences are greatly magnified, to such an extent that the shape of the plate is impaired, to say nothing of the fluctuation in steel quality caused by the temperature differences at the start of cooling.

(3) Influence of running water on the plate

When a steel plate is placed horizontally and subjected to cooling by transient running water, the cooling water applied from the top side of the plate flows outward and then downward over the edge portions. Therefore, the largest amount of water flows over the edge portions on the top surface of the steel plate so that the cooling rate is rapid in this region. Regardless of plate thickness, this action of the running water occurs only on the top surface of the plate. Moreover, the effect of this action increases with increasing plate width.

In order to deal with the above-mentioned factors which tend to cause variation in the cooling rate in the width direction of the steel plate, it has generally been the practice to apply to only the top surface of the plate a fixed-type "crown of water" (wherein the amount of water applied is greater at the center portion of the plate than at the edges).

The term "water volume profile" as used in this specification refers to the distribution profile of running cooling water applied to the surface of a steel plate. The term "crown" refers to such a profile with the shape of the top in a crown.

The water volume profile applied should desirably differ from plate to plate depending on the differences in plate thickness and width referred to in items (1)–(3) above. Moreover, these same factors will determine whether a water volume profile should be applied from only one side or from both sides.

Table 1 shows the water volume profile with a crown required on both sides of a steel plate in quantitative terms.

TABLE 1

| | Plate thickness | | | | |
|---|---|---|---|---|---|
| | Thin | | Thick | | Surfaces requiring water volume crown |
| | Plate width | | | | |
| Phenomena | narrow | wide | narrow | wide | |
| (1) plate crown | medium | large | none | small | top and bottom surfaces |
| (2) fluctantions of plate | medium | large | almost | small | top and bottom |

TABLE 1-continued

| Phenomena | | Plate thickness: Thin, Plate width: narrow | Thin, wide | Thick, narrow | Thick, wide | Surfaces requiring water volume crown |
|---|---|---|---|---|---|---|
| temperature | | | | none | | surfaces |
| (3) running water on the plate | | small | large | small | large | top surface only |
| Required water volume crown | Top surface | medium | large | small | large | |
| | Bottom surface | medium | large | none necessary | small | |

In the case of a slit nozzle, it is technically feasible to remotely control the header mechanism so as to control the water volume profile applied to each plate in accordance with its size. However, the mechanism required for this would be so complicated as to raise many problems from the viewpoint of equipment cost and maintenance. Accordingly, as a practical matter, it has been possible to supply only specific types of water volume profile to the top surface of a plate by selection of specific slit widths or types of nozzles.

SUMMARY OF THE INVENTION

It is the principal object of the present invention to provide a cooling apparatus for uniformly cooling a thick steel plate of various specifications, kinds and properties.

It is another object of the invention to provide a cooling apparatus for cooling a thick steel plate in compliance with the specifications, kind and properties of the plate in order to obtain uniform steel properties.

BRIEF DESCRIPTION OF THE DRAWINGS

Other and further objects of the present invention will be better understood from the following detailed description with reference to the accompanying drawings, in which.

DETAILED DESCRIPTION OF THE INVENTION

Figure 1:
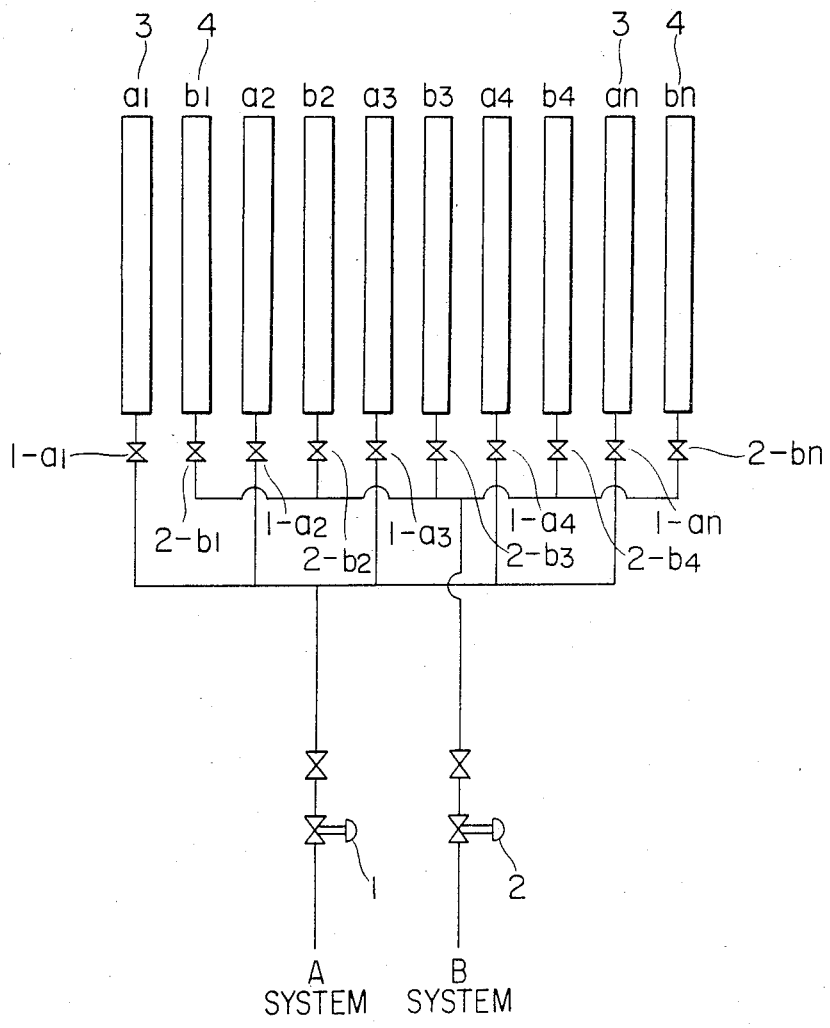
FIG. 1 is a schematic view of a cooling apparatus in accordance with an embodiment of the invention.

The present invention relates to a cooling apparatus for cooling a thick steel plate in which the water volume profile can be varied from plate to plate by a simple mechanism in a manner which assures the optimum profile for each plate. FIG. 1 shows a group of constituent elements provided at the cooling zone over the top surface of a steel plate in accordance with an embodiment of the present invention.

The nozzle group for the top surface of the plate consists of two systems, A and B, which are provided with water control valves 1 and 2, respectively, and with numerous headers $3a_1$–$3a_n$ and $4b_1$–$4b_n$. These systems use headers which supply the water volume profiles shown in FIGS. 2*a* and 2*b*.

More specifically, in the present invention a base (not shown) is arranged to have a conveyance path for an elongated thick steel plate and a plurality of rod-like headers 3, 4 are provided on the base and extending in the width direction of the plate across the conveyance path so as to adequately cover the entire plate width and to extend crosswise to the running direction of the plate. The headers are provided with a plurality of flow control valves 1-*a*, 2-*b*, . . . capable of finely controlling the amount of water supplied to each of the headers.

The headers are divided into at least two systems (system A and system B in the drawing) and each system is connected to a water supply means (not shown) via a flow valve (1 or 2). There is thus constituted a first nozzle group $a_1$–$a_n$ and a second nozzle group $b_1$–$b_n$, each of which is capable of supplying a different water volume profile. As shown in the drawing, the headers $a_1$, $a_2$, . . . of system A and the headers $b_1$, $b_2$, . . . of the system B are arranged alternately side by side in series.

Therefore, the profile produced by the headers of system A differs from that produced by the headers of system B.

In the above explanation, the cooling water supply means is provided with two systems, A and B, but it is understood that the system is not limited thereby.

In addition, with reference to the arrangement of the system of headers, it is seen that the following arrangement may be adopted: a combined group of header $a_1$ and header $a_2$ can be made, and another combined group of header $b_1$ and header $b_2$ can also be made, and the combined group of headers $a_1$ and $a_2$ can be alternately arranged side by side with the combined group of headers $b_1$ and $b_2$ (e.g., $a_1$, $a_2$, $b_1$, $b_2$, . . . ).

Figure 2:
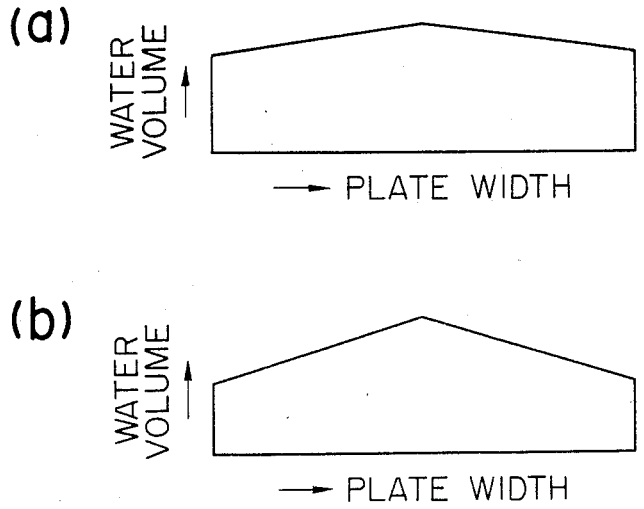
FIGS. 2*a* and 2*b* are diagrammatic views showing models of the water distribution profile in the width direction provided by system A and system B headers respectively.

The water volume profile shown in FIG. 2(*a*), which is supplied by the headers of system A, has a crown suitable for treating those plates among all plates to be treated which require the smallest water crown (namely, plates corresponding to the thick and narrow plate described in Table 1).

The water volume profile shown in FIG. 2(*b*), which is supplied by the headers of system B, has a crown suitable for treating those plates among all plates to be treated which require the largest water crown (namely, plates corresponding to the thin and wide plate described in Table 1).

In the cooling apparatus of the invention, a plate of such size that it requires the largest water crown is cooled by water distributed by system B alone and a plate of such size that it requires the smallest water crown is cooled by system A alone.

When a plate of an intermediate size is treated, a crown of intermediate size will do. Therefore, in such case, the amount of water supplied through the systems A and B is controlled to obtain the water volume profile with the crown appropriate for the plate concerned.

Figure 3:
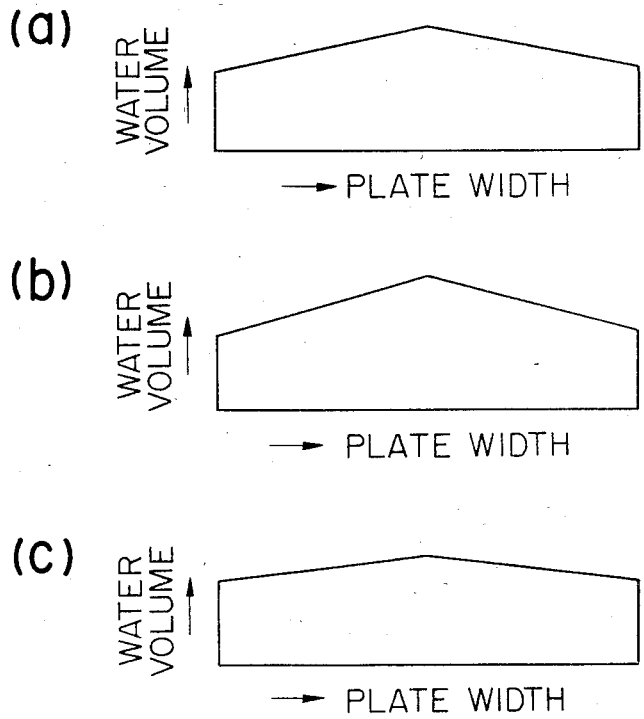
FIGS. 3*a* and 3*b* are diagrammatic views showing models of water distribution profile obtained by controlling the amount of flow through the systems A and B.

FIGS. 3*a*–3*c* shows how the water volume profile changes as the proportion of the water supplied through each of systems A and B is changed. FIG. 3(*a*) shows the crown obtained when the water supply is 1/2A+1/2B, FIG. 3(*b*) shows that for 1/3A+2/3B, and FIG. 3(*c*) that for 2/3A+1/3B.

In accordance with the present invention, it is possible to change not only the size of the water volume profile but also the pattern shape thereof. In general, the required pattern of the water volume profile varies somewhat from case to case.

Figure 4:
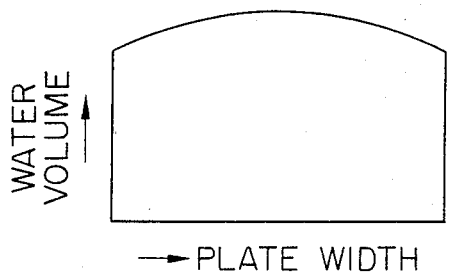
FIGS. 4–6 are diagrammatic views showing models of water distribution profile for corrective purposes.
Figure 5:
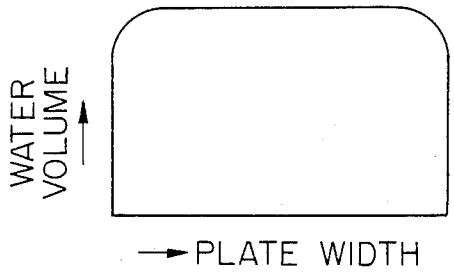
Figure 6:
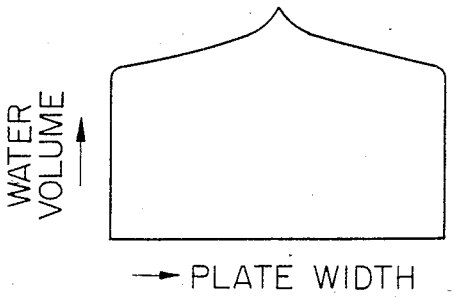

FIG. 4 shows a profile pattern used for correcting variation in cooling rate caused by the plate crown. FIG. 5 shows a profile pattern for dealing with fluctuations in temperature in the width direction of the plate. FIG. 6 shows a profile pattern used for preventing overcooling of the edge portions of a plate caused by water flowing over the plate in the width direction.

As is clearly shown in FIGS. 4–6, profile patterns differ according to the purpose they are intended to attain.

Therefore, accurate cooling can be carried out by combining headers capable of supplying water profiles of the patterns shown in FIGS. 4–6 with each other or with headers for supplying a flat water distribution profile, so as to obtain an optimum water profile for the steel plate to be cooled. Moreover, the supply of the cooling water can also be carried out as required using three or more header systems each capable of providing a different water volume profile.

Next the method for causing the respective header systems to supply the desired water profiles will be explained.

Figure 7:
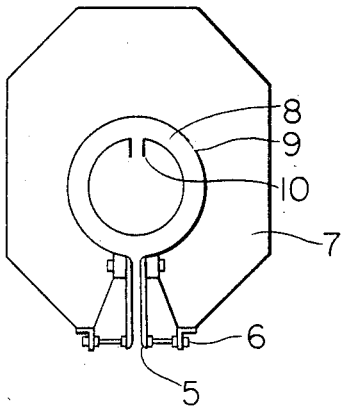
FIG. 7 is a schematic view of a slit lamina type nozzle.

FIG. 7 is a detailed view of a slit lamina type nozzle comprising a nozzle plate 5, a bolt 6 for adjusting the slit width, a reinforcing flange 7, an inner tube 8, an outer tube 9, and a short tube 10 for rectifying the water flow.

Figure 8:
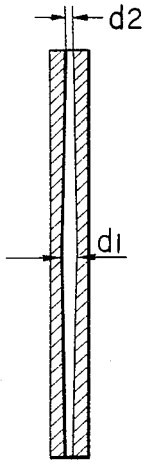
FIG. 8 is an explanatory view of the end face of a nozzle.

As shown in FIG. 8, the slit width d of the nozzle varies in the longitudinal direction of the slit (i.e. in the width direction of the steel plate) between the center and the opposite ends. This variation can be either continuous or stepwise.

The view of the slit shown in FIG. 8 is somewhat exaggerated; in actual fact the difference between $d_1$ and $d_2$ in a slit 4 m long is as small as 2 mm.

Figure 9:
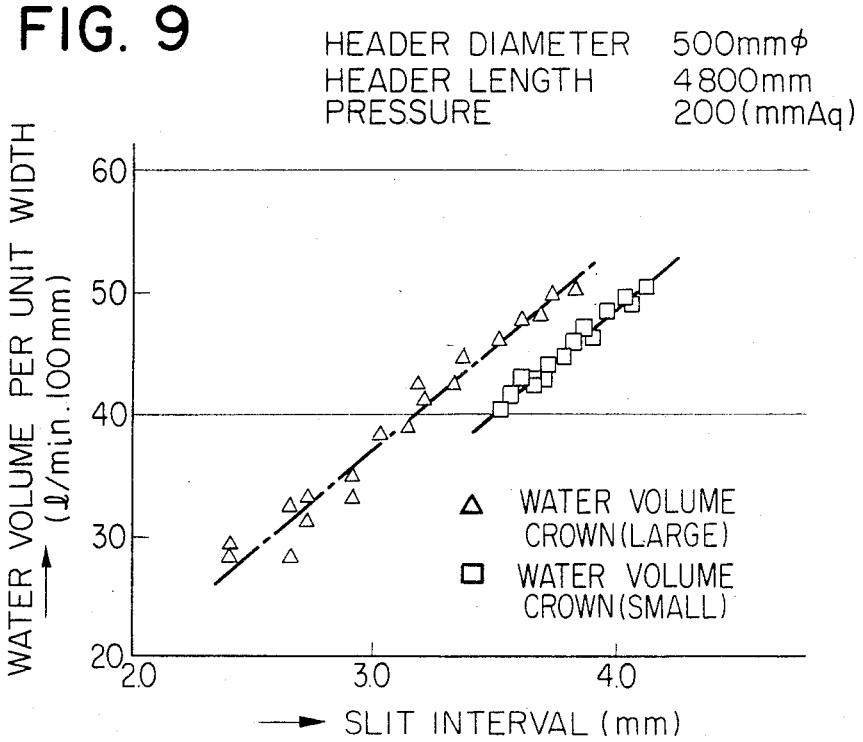
FIG. 9 is a graph showing the relationship between slit width and the amount of water.

FIG. 9 shows the relationship between the amount of water supplied per unit width in the longitudinal direction (plate width direction) of the nozzle and the slit width in the above-described header of the slit lamina type. The relation is almost linear. Thus it will be understood that by varying the slit width, it is possible to obtain a corresponding change in the amount of water supplied, by which means the required water crown can be attained.

Figure 10:
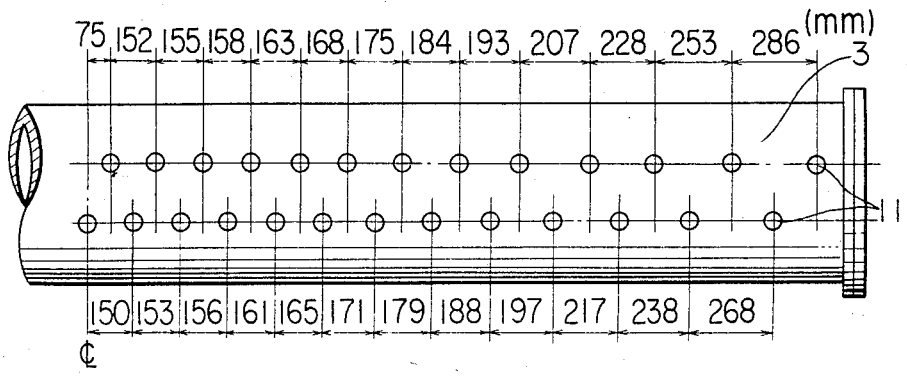
FIG. 10 is a schematic view showing a nozzle in accordance with another embodiment.
Figure 11:
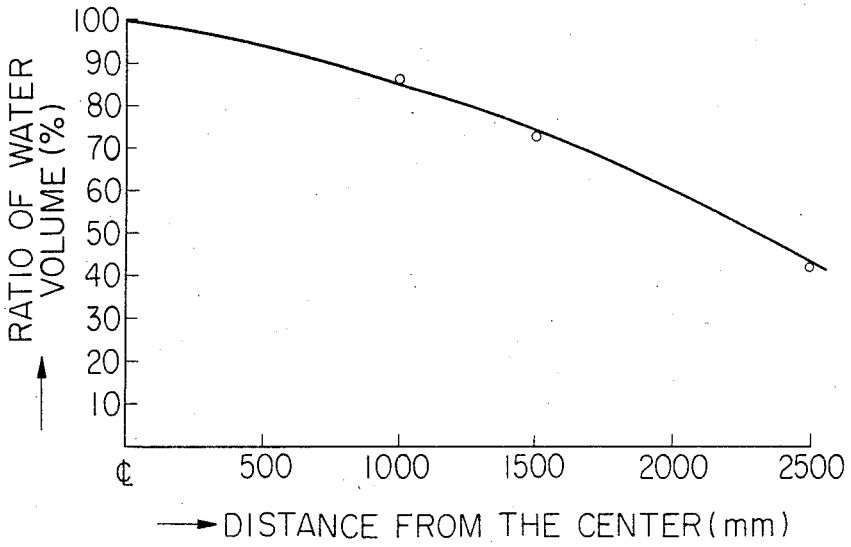
FIG. 11 is a diagram showing the relationship between the nozzle pitch and the water volume.
Figure 12:
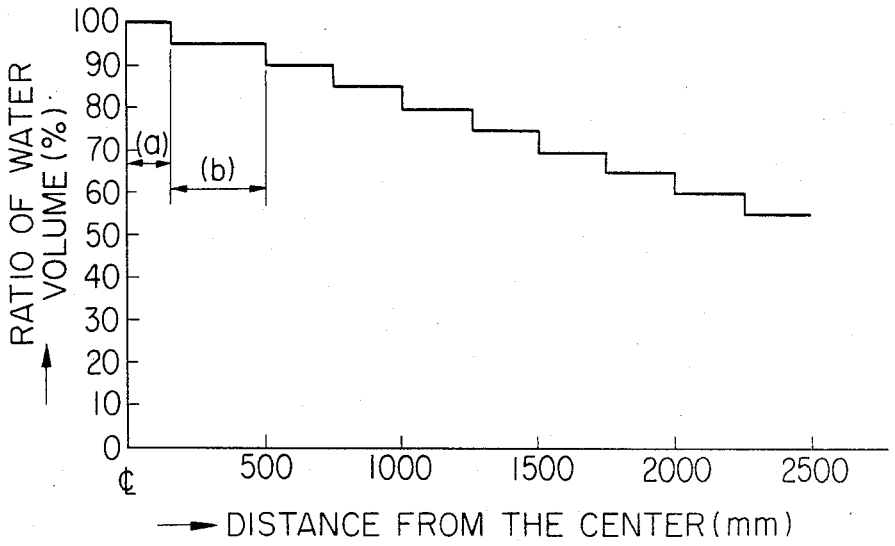
FIG. 12 is a diagram showing the relationship between the nozzle bore and the water volume.

FIGS. 10–12 show the method of attaining the desired crown in the case where the nozzles are of the pipe lamina type or where headers equipped with nozzles are used, and the results obtained with the profile obtained.

As shown in FIG. 10, a desired water volume crown is obtained by providing nozzles (or drilled holes) of the same bore size more closely spaced toward the center of the header and more widely spaced toward the ends.

FIG. 11 shows the results of a test carried out using the system shown in FIG. 10. It will be noted that a desired distribution of the water in the width direction of the steel plate can be obtained. In this system it is also possible to use a fixed nozzle pitch and instead to vary the nozzle type, i.e. the nozzle bore in the lengthwise direction of the header. A combination of these two methods can also be used.

FIG. 12 shows an example of the water volume profile obtained in a test of a header wherein the nozzle bore is varied so that the amount of water supplied by the end nozzles (b) is 5% less than that supplied by a center nozzle (a).

In addition there can also be used headers wherein, as disclosed in Japanese published unexamined patent application No. 153616/80, nozzles at a fixed pitch and having the same size bore are provided in rows having different effective lengths.

The above described systems can be applied either to a cooling system wherein the steel plate is cooled without restraint or to a cooling system wherein the plate being cooled is restrained by, for example, a roll. In the case where the plate is restrained, the spray system is more effective, but in this case too the concept of supplying a water volume profile with a crown in the width direction of the steel plate from each of the headers remains unchanged.

The above explanation relates to an embodiment wherein each steel plate is cooled using one specific water volume profile throughout its entire length. In fact, however, there are cases in which it is necessary to vary the cooling pattern in the longitudinal direction of the steel plate. This is particularly true in the case of a long plate.

Figure 13:
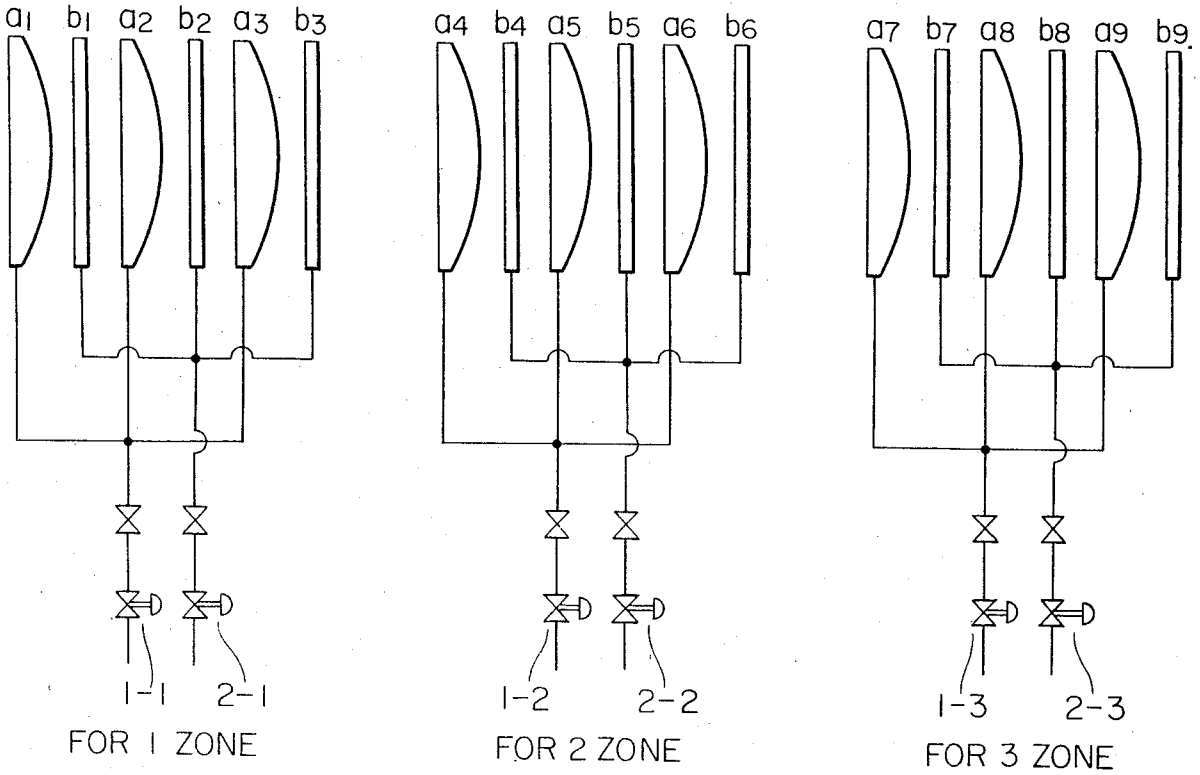
FIG. 13 is a schematic view of a cooling apparatus in accordance with an embodiment of the invention.

To make it possible to satisfy this necessity, the cooling zone is divided into a desired number of sub-zones, for example, into three cooling sub-zones as shown in FIG. 13. Each of these zones is provided with two headers systems, system A and system B, and the header systems for the respective sub-zones, one having headers producing a crown-shaped profile and the other having headers producing flat profile, are provided with flow control valves 1-1–1-3 and 2-1–2-3. With this arrangement, a different water volume profile can be applied at different cooling temperature regions of the plate in the longitudinal direction.

In addition, when it is necessary to compensate for fabrication errors in the respective headers or to control the water volume profile with very high precision, this can be done by adjusting the flow control valves 1-$a_1$–1-$a_n$ and 2-$b_1$–2-$b_n$ shown in FIG. 1. If required, all such adjustments can be carried out automatically.

Next, an actual example of the application of the cooling apparatus of the present invention to the cooling of thick steel plates will be described.

(1) Size of Steel Plate (m/m)
(a) Thickness 35; Width 2500; Length 8000
(b) Thickness 25; Width 3000; Length 1000
(c) Thickness 12; Width 3500; Length 11000

(2) Cooling Conditions

| | Start of cooling, (°C.) | End of coolend, (°C.) | Density of water volume | Water volume crown |
|---|---|---|---|---|
| (a) | 804 | 110 | 0.8 ($m^2$/min. $m^2$) | FIG. 2(b) |
| (b) | 800 | 101 | 0.8 | FIG. 3(a) |
| (c) | 794 | 54 | 0.8 | FIG. 2(a) |

Figure 14:
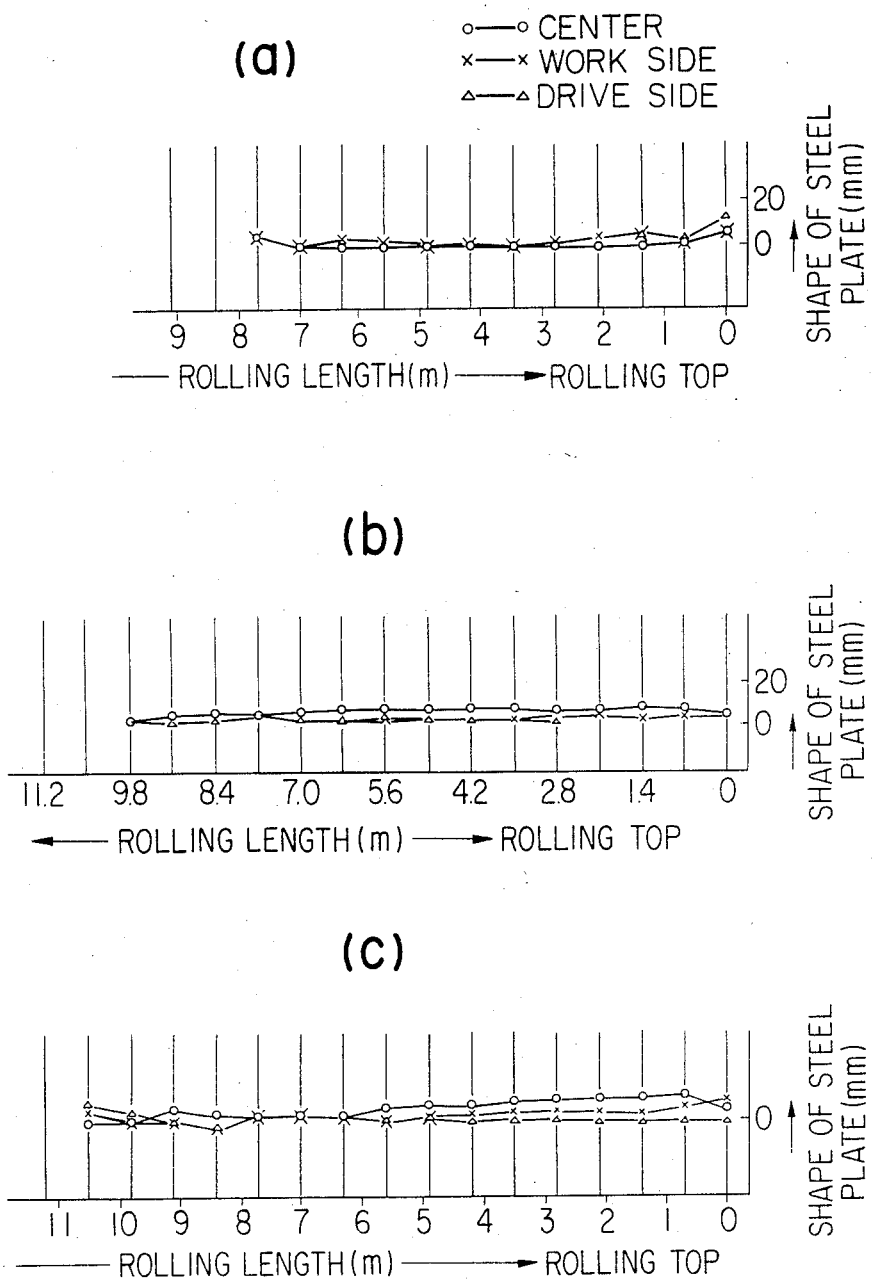
FIGS. 14*a*–14*c* are diagrams showing the results obtained by the use of the apparatus according to this invention.

The shapes of the plates (a)-(c) processed under the conditions shown above are shown in FIGS. 14 (a)-(c), respectively. It will be noted that by overcoming the various problems described earlier, it was possible to obtain steel plates with excellent flatness.

If, in the use of the apparatus according to the present invention, the apparatus is linked with the process computer and the various sensors currently used for controlling the rolling line, it will be possible in most cases to determine the specific profile required for each steel plate. For instance; (1) the plate crown can be known from the measured value provided by the γ-ray thickness gage at the rear of the rolling mill; (2) the temperature distribution of the steel plate can be obtained in advance from a thermometer, thermovision or the like; and (3) the differences in cooling capacity resulting from differences in the volume of water flow can be worked out using computer simulation so that each and every plate can be uniformly cooled, thus making it possible to attain much greater uniformity not only in the shape of the plate but also in the quality of the steel.

Furthermore, existing cooling apparatus not capable of supplying a water volume profile with a crown can be modified in accordance with this invention by incorporating therein (to the degree that this does not lead to problems regarding header pitch etc.) a separate header system capable of supplying a water volume profile.

We claim:

1. A cooling apparatus for applying cooling water in the form of a water volume profile to the surfaces of a variety of steel plates having an elongated strip form and traveling in the direction of their lengths for uniformly cooling the plates, the plates having a width ranging from narrow to wide and a thickness ranging from thin to thick, the variety of plates requiring a range of shapes of water volume profiles from a profile with a maximum crown to a profile with less of a crown than said maximum crown, said apparatus comprising:

a base extending in the direction of travel of said steel plate and having a plate conveying path with a width for accommodating the widest plate to be cooled;

a plurality of rod-like headers on said base and extending in the width direction of the steel plates across substantially the entire width of the conveying path;

a cooling water source;

said plurality of headers being in a plurality of header groups each consisting of a plurality of headers, the headers in each group each being provided with an adjustable valve for controlling the volume of water flow to the individual headers, said headers in one group being interspersed among the headers of the other group or groups, the headers in each group being connected in parallel to said cooling water source;

a flow control valve connected between each header group and said cooling water source;

each of said headers having unvalved nozzle means thereon and positioned along the length of the header and directed toward the steel plate conveying path, the nozzle means on the headers of each group having nozzle openings for supplying to said steel plate cooling water in a water volume profile distributed in the direction of the width of the steel plates, the nozzle means on the headers of one group forming a water volume profile having a crown corresponding to the maximum crown needed for cooling steel plates at one end of the range of shapes of steel plates uniformly across the width thereof, and the nozzle means on the headers of at least one of the other groups forming a water volume profile having a shape between a water volume profile with a lesser crown than the crown of the headers of said one group and a water volume profile with no crown, for, when it is combined with the water volume profile of the headers of said one group, producing a water volume profile having less of a crown than the maximum crown produced by the headers of said one group of headers.

2. A cooling apparatus as claimed in claim 1 in which the nozzle means on the headers of said at least one of the other groups forming a water volume profile having a crown needed for cooling steel plates at the other end of the range of shapes of steel plates.

3. A cooling apparatus as claimed in claim 1 in which the nozzle means on the headers of said at least one of the other groups forming a water volume profile which is flat.

4. A cooling apparatus as claimed in claim 1 wherein said nozzle means consists of an outer tube extending along said header, an inner tube within and concentric with said outer tube, said inner tube having a longitudinal slit therein opening into said outer tube, said adjustable valve being connected to said inner tube to admit cooling water into said inner tube, said inner tube having flanges along the edges of said slit and extending into said inner tube to define a short tube from said inner tube to said outer tube, and said outer tube having a slit therein spaced around said outer tube from the point at which said inner tube opens into said outer tube, said nozzle means being constituted by a pair of nozzle plates on the opposite sides of said outer tube slit, one of which is adjustable toward and away from the other, and means for adjusting the adjustable nozzle plate.

5. A cooling apparatus as claimed in claim 1 wherein said headers each comprise a tube, and said nozzle means is constituted by a plurality of nozzles in said tube and directed toward said steel plate, said nozzles being closely spaced near the center of said header in the width direction of said steel plate, and being more widely spaced near the edges of said steel plate.

6. A cooling apparatus for applying cooling water in the form of a water volume profile to the surfaces of a variety of steel plates having an elongated strip form and traveling in the direction of their lengths for uniformly cooling the plates, the plates having a width ranging from narrow to wide and a thickness ranging from thin to thick, the variety of plates requiring a range of shapes of water volume profiles from a profile with a maximum crown to a profile with less of a crown than said maximum crown, said apparatus comprising:

a base extending in the direction of travel of said steel plate and having a plate conveying path with a width for accommodating the widest plate to be cooled;

a plurality of rod-like headers on said base and extending in the width direction of the steel plates across substantially the entire width of the conveying path;

a cooling water source;

said plurality of headers being in a plurality of header groups each consisting of a plurality of headers, the headers in each group each being provided with an adjustable valve for controlling the volume of water flow to the individual header, said headers in each group being in a plurality of subgroups with the headers in each subgroup being interspersed among the headers of the other subgroup or subgroups in a header group, the headers in each subgroup being connected in parallel to said cooling water source;

a flow control valve connected between each header subgroup and said cooling water source;

each of said headers having unvalved nozzle means thereon and positioned along the length of the header and directed toward the steel plate conveying path, the nozzle means of the headers of each subgroup having nozzle openings for supplying to said steel plate cooling water in a water volume profile distributed in the direction of the width of the steel plates, the nozzle means on the headers of one subgroup in one header group forming a water volume profile having a crown corresponding to the maximum crown needed for cooling steel plates at one end of the range of shapes of steel plates uniformly across the width thereof, and the nozzle means on the headers of at least one of the other subgroups in said one header group forming a water volume profile having a shape between a water volume profile with a lesser crown than the crown of the headers of said one group and a water volume profile with no crown, for, when it is combined with the water volume profile of the headers of said one subgroup, producing a water profile of the headers of said one subgroup, producing a water volume profile having less of a crown than the maximum crown produced by the headers of said one subgroup of headers, the nozzle means on the headers of one subgroup in a further header group forming a water volume profile having a crown corresponding to a further desired crown needed for cooling steel plates among the variety of steel plates uniformly across the width thereof, which lastmentioned crown is different from the crown for the nozzles of said one subgroup in said one header group, and the nozzle means on the headers of at least one of the other subgroups in said further header group forming a water volume profile having a shape between a water volume profile with a lesser crown than the crown of the headers of said one subgroup in a further header group and a water volume profile with no crown, for, when it is combined with the water volume profile of the headers of said one subgroup in said further header group, producing a water volume profile having less of a crown than the crown produced by the headers of said one subgroup of headers in said further group of headers.

* * * * *